US011330952B2

(12) United States Patent
Zhou

(10) Patent No.: US 11,330,952 B2
(45) Date of Patent: May 17, 2022

(54) PROCESSING STATION AND CLEANING SYSTEM

(71) Applicant: Shenzhen Silver Star Intelligent Technology Co., Ltd., Shenzhen (CN)

(72) Inventor: Feng Zhou, Shenzhen (CN)

(73) Assignee: Shenzhen Silver Star Intelligent Technology Co., Ltd, Shenzhen (CN)

( * ) Notice: Subject to any disclaimer, the term of this patent is extended or adjusted under 35 U.S.C. 154(b) by 414 days.

(21) Appl. No.: 16/667,355

(22) Filed: Oct. 29, 2019

(65) Prior Publication Data

US 2020/0345195 A1 Nov. 5, 2020

(30) Foreign Application Priority Data

Apr. 30, 2019 (CN) ..... 201910364592.8

(51) Int. Cl.
*A47L 11/40* (2006.01)
*A47L 9/28* (2006.01)

(52) U.S. Cl.
CPC ..... *A47L 11/4025* (2013.01); *A47L 9/2873* (2013.01); *A47L 11/4066* (2013.01); *A47L 2201/024* (2013.01)

(58) Field of Classification Search
CPC ..... A47L 11/4025; A47L 11/4066; A47L 2201/024; A47L 9/009; A47L 9/1409; A47L 9/149; A47L 9/2873
See application file for complete search history.

(56) References Cited

U.S. PATENT DOCUMENTS

2009/0049640 A1* 2/2009 Lee ..... A47L 9/20 15/319
2016/0183752 A1* 6/2016 Morin ..... A47L 9/1683 134/18

FOREIGN PATENT DOCUMENTS

CN 107405031 A 11/2017
DE 102013103086 A1 * 10/2014 ..... A47L 9/20

* cited by examiner

*Primary Examiner* — Marc Carlson
(74) *Attorney, Agent, or Firm* — Robert L. Stearns; Dickinson Wright, PLLC

(57) ABSTRACT

The present application discloses a processing station and a cleaning system. The cleaning system includes a processing station and a cleaning robot, the processing station for evacuating trash collected in the cleaning robot, and including a body formed with a sealing surface, a base located below the sealing surface and configured for supporting a trash cassette having an opening at a top, a suction mechanism and a filter, and an adjustment member connected the body with the base; the adjustment member urges the base to be vertically adjacent to the sealing surface to clamp the trash cassette between the base and the sealing surface, such that the opening edge of the trash cassette abuts against the sealing surface.

17 Claims, 8 Drawing Sheets

PROCESSING STATION AND CLEANING SYSTEM

CROSS-REFERENCE TO RELATED APPLICATIONS

This application is claimed priority to Chinese Patent Application No. 2019103645928, filed on Apr. 30, 2019, the contents of which are incorporated herein by reference.

TECHNICAL FIELD

The present application relates to the technical field of cleaner, and more particularly to a processing station and a cleaning system.

BACKGROUND

An autonomous navigation cleaning robot is a device that is configured to perform a cleaning task while traveling in any area without requiring user control, and is generally configured to collect the trash on the ground into a trash cassette carried therein. In order to reduce the frequency of dumping trash in the trash cassette and cleaning the trash cassette, there is a processing station in the prior art which forms a cleaning system together with the cleaning robot, and the processing station uses a suction force of a fan therein to evacuate the trash received in the trash cassette, and some of the processing stations have the function of docking and charging with the robot. The invention patent (publication No. CN107405031A) has recorded a processing station using a filter bag, while the filter bag has poor versatility and high production cost, and is not conducive to widespread promotion.

SUMMARY

An object of embodiments of the present application is to provide a processing station and a cleaning system, in order to solve the problem that the versatility of the trash cassette in the prior art is poor, and the production cost is high.

In order to solve the problem above-mentioned, embodiments of the present application provide technical solutions as follow:

A processing station for evacuating trash collected in a cleaning robot, including a body, wherein a bottom of the body is provided with a trash suction port, and the body is provided with an air outlet and a trash outlet, the trash outlet is in communication with the trash suction port, and the body is formed with a sealing surface;

a base, located below the sealing surface and configured for supporting a trash cassette having an opening at a top;

a suction mechanism and a filter, assembled to the body, wherein the suction mechanism is in communication with the opening and the air outlet; and an adjustment member, connected with the body and the base and configured to urge the base to be vertically adjacent to the sealing surface to clamp the trash cassette between the base and the sealing surface, such that the opening edge of the trash cassette abuts against the sealing surface;

wherein an air pressure formed during the operation of the suction mechanism sequentially transports the trash collected in the cleaning robot through the trash suction port, the trash outlet, and the opening and precipitates into the trash cassette through a filtering action of the filter.

Wherein the adjustment member comprises a spring; wherein the trash cassette is placed on the base by an external force to lower the base, and when the external force is released, the spring provides an elastic force to urge the base to be adjacent to the sealing surface in the vertical direction.

Wherein the adjustment member further comprises a power mechanism mounted to the body, and the power mechanism configured to provide the external force for driving the base to drop.

Wherein the sealing surface is provided with a pressure sensor communicatively connected to the power mechanism, and the power mechanism adjusts the base based on detection information of the pressure sensor.

Wherein the adjustment member further comprises a power mechanism mounted to the body, and the power mechanism configured to urge the base in a vertical direction adjacent to and away from the sealing surface.

Wherein the sealing surface comprises an arc surface raised toward the base; when the trash cassette is clamped between the base and the sealing surface, the opening edge of the trash cassette abuts against the arc surface.

Wherein the arc surface is covered with a sealing soft glue layer.

In order to solve the problem above-mentioned, embodiments of the present application has further provided the technical solutions as follow:

A processing station for evacuating trash collected in a cleaning robot, including:

a body, wherein a bottom of the body is provided with a trash suction port;

a receiving case, slidably connected to a top of the body in a vertical direction; wherein a bottom of the receiving case is formed with a sealing surface and is provided with an air outlet and a trash outlet, and the trash outlet is connected with the trash suction port;

a suction mechanism and a filter, disposed in the receiving case; and a base, located below the receiving case and configured for supporting a trash cassette having an opening at a top;

wherein the trash cassette is placed on the base after the receiving case is raised by an external force, and when the external force is released, the receiving case is adjacent to the base to clamp the trash cassette between the base and the receiving case, such that the opening edge of the trash cassette abuts against the sealing surface; wherein an air pressure formed during the operation of the suction mechanism sequentially transports the trash collected in the cleaning robot through the trash suction port, the trash outlet, and the opening and precipitates into the trash cassette through a filtering action of the filter.

Wherein the arc surface is covered with a sealing soft glue layer.

Wherein the base is provided with an alignment detection device and an information prompting device; wherein the alignment detection device is configured to generate a feedback information when the trash cassette is detected offset from a preset position on the base; the information prompting device is configured to generate the correction prompt information according to the prompting of the feedback information.

Wherein the base is a transparent glass plate, and the alignment detection device comprises a image detection device located below the base and disposed toward the base.

In order to solve the problem above-mentioned, embodiments of the present application has further provided the technical solutions as follow:

A cleaning system includes a cleaning robot and the processing station of any one above-mentioned.

Wherein the cleaning robot includes:

a robot body, wherein a bottom of the robot body is provided with a dust suction port;

a drive system, configured to drive the cleaning robot to travel on the ground;

a trash receiving case, wherein an inlet of the trash receiving case is in communication with the dust suction port; and a fan, which the trash on the ground to sequentially enter the trash receiving case from the dust suction port and the inlet when the fan is activated.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

DETAILED DESCRIPTION

Figure 1:
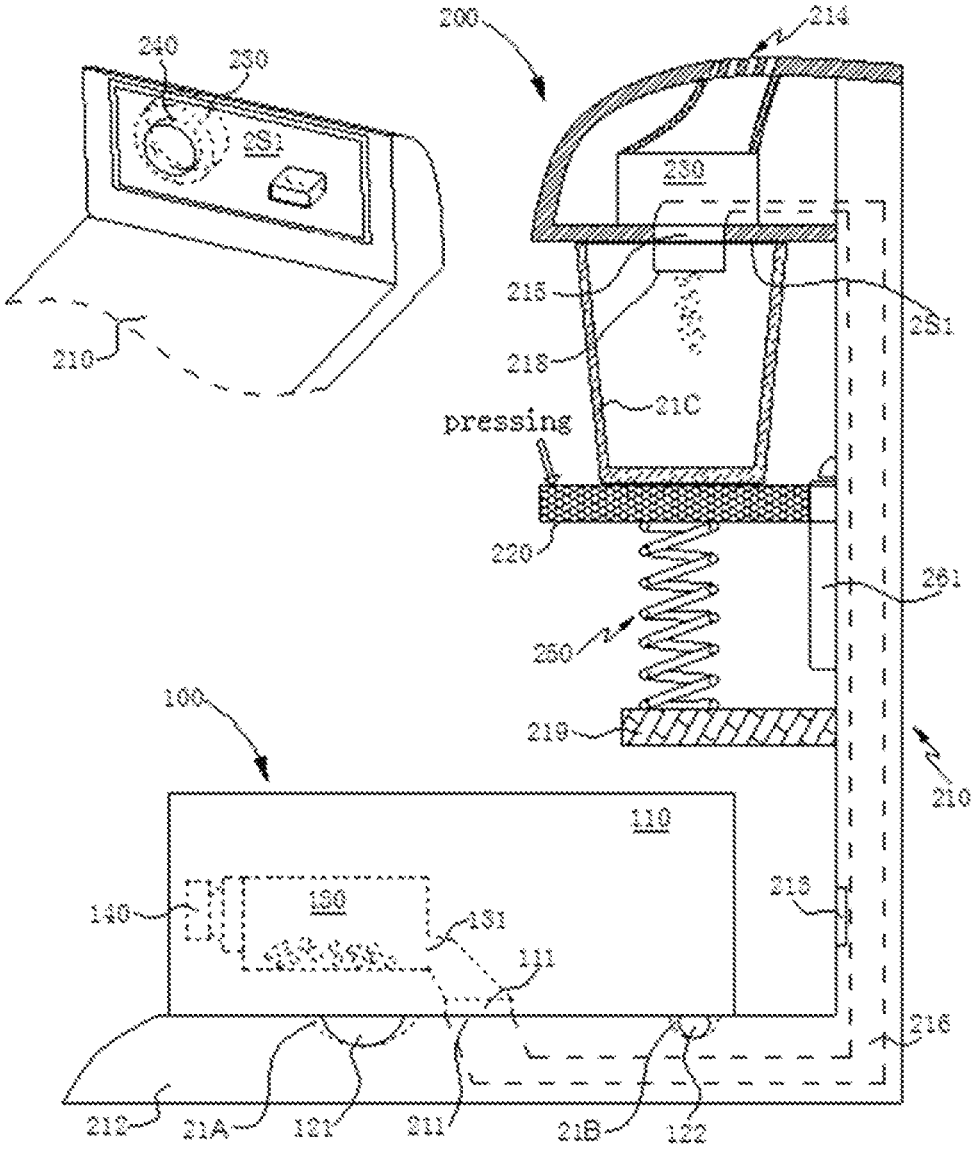
FIG. 1 is a structural schematic view of a side cross-section of a cleaning system according to an embodiment of the present application.

The technical solutions in the embodiments of the present application will be clearly described with reference to the accompanying drawings in the embodiments of the present application. It is obvious that the described embodiments are only a part of the embodiments of the present application, and not all of the embodiments. All other embodiments obtained by those skilled in the art based on the embodiments of the present application without creative efforts are within the scope of the present application.

In the embodiment of the present application, the singular expression may include plural expressions when it is not explicitly antisense. In addition, the terms "including" or "having" are used to mean the presence of the features, numbers, steps, operations, components, components or combinations thereof recited in the specification without the exclusion of the existence or additional possibilities of one or more other features, numbers, steps, operations, components, components or combinations. Also, the terms "first", "second" and the like, which are used in the specification, may be used to describe various constituent elements, but the constituent elements are not limited by the above terms, and the terms are only used to distinguish one components and other components.

Hereinafter, embodiments of the present application disclosed will be described in detail with reference to the accompanying drawings. In the drawings, the same numbers or symbols shown in the drawings may represent components or constituent elements that perform substantially the same functions.

FIG. 1 is a structural schematic view of a side cross-section of a cleaning system according to an embodiment of the present application. The cleaning system includes a cleaning robot 100 and a processing station 200 adapted to evacuate trash received in the cleaning robot 100. The cleaning robot 100 includes: a machine body 110, a drive system, a trash receiving case 130 and a fan 140. A bottom of the machine body 110 is provided with a dust suction port 111, and the dust suction port 111 is not limited to a rectangular or waist shape extending in the left-right direction of the cleaning robot 100, in an optional embodiment, it may be any other shape.

The drive system is configured to drive the cleaning robot 100 to travel on the ground. In the embodiment of the present application, the drive system includes: two driving wheels 121, a motor for driving the driving wheels 121 to rotate (not shown), and a universal wheel 122. The two driving wheels 121 are respectively disposed on the left and right sides of the machine body 110. The universal wheel 122 may be disposed at the front or the tail of the machine body 110, and the front and the tail of the machine body 110 may be respectively provided with a universal wheel 122.

An inlet 131 of the trash receiving case 130 is in communication with the dust suction port 111, and in the embodiment of the present application, the trash receiving case 130 is detachably mounted on the machine body 110. The trash receiving case 130 can be pulled out from a top of the machine body 110 or can be pulled out from a tail of the machine body 110. In order to increase the sealability of the inlet 131 of the trash receiving case 130 after docking with the dust suction port 111, a seal ring may be provided around the edge of the inlet 131 of the trash receiving case 130 and/or the edge of the dust suction port 111.

When the fan is started, the trash on the ground is sequentially moved from the dust suction port 111 and the inlet 131 entering into the trash receiving case 130. It should be noted that the fan can be assembled integrally with the trash receiving case 130, and can be detachably mounted on the machine body 110; the fan can also be a relatively separate structural member from the trash receiving case 130.

Embodiment 1

Figure 2:
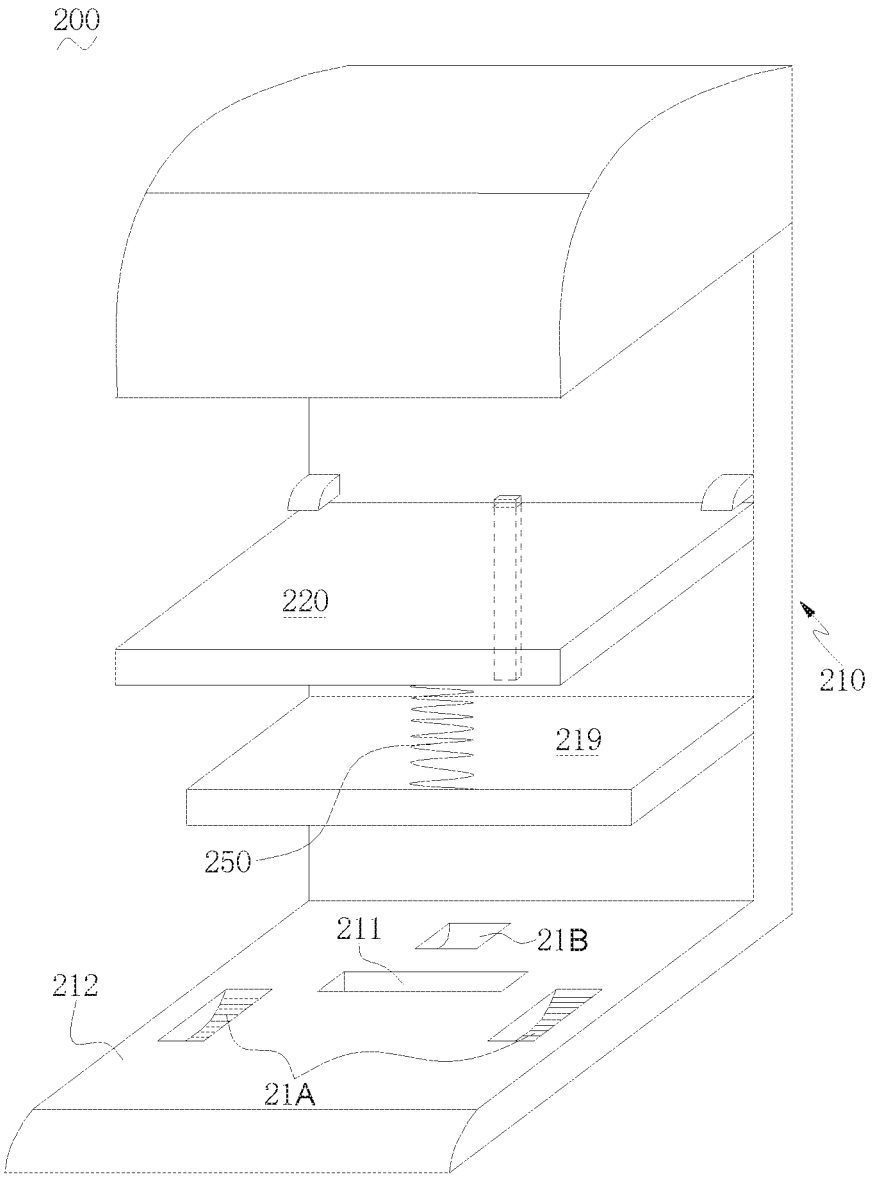
FIG. 2 is a schematic view perspective structure of a processing station shown in FIG. 1.

FIG. 2 is a schematic view of perspective structure of the processing station shown in FIG. 1. The processing station 200 includes: a body 210, a base 220, a suction mechanism 230, and a filter 240 and an adjustment member. In the embodiment of the present application, the adjustment member includes a spring 250 as an example for description.

A bottom of the body 210 is provided with a trash suction port 211. In the embodiment of the present application, the bottom of the body 210 is formed with a bottom base 212, and the trash suction port 211 is provided on the bottom base 212. When the cleaning robot 100 travels to a preset position on the bottom base 212, for example, the trash suction port 211 is docked with the dust suction port 111; for example, the cleaning robot 100 may additionally provide a trash evacuation port in communication with the trash receiving case 130, and the trash suction port 211 is docked with the trash evacuation port. In the embodiment of the present application, the trash suction port 211 is docked with the dust suction port 111 as an example for description.

In order to realize a function of the processing station 200 charging the cleaning robot 100, the body 210 can be provided with a metal contact, and when a charging contact on the cleaning robot 100 comes into contact with the metal contact on the body 210, the docking charging of the cleaning robot 100 is realized. In addition, in order to guide the cleaning robot 100 to accurately dock with the processing station 200, such that the trash suction port 211 is aligned with the dust suction port 111 of the cleaning robot 100, and the body 210 may be provided with an optical signal guiding system 213, the cleaning robot 100 receives an optical signal (such as an infrared ray) sent by the optical signal guiding system 213 to find the processing station 200 and to achieve precise docking with the processing station 200.

The bottom base 212 is provided with a first groove 21A for accommodating the driving wheel 121 and a second groove 21B for accommodating the universal wheel 122. In the embodiment of the present application, the preset position represents the position when the driving wheel 121 enters the first groove 21A and the universal wheel 122 enters the second groove 21B.

The body 210 is provided with an air outlet 214 and a trash outlet 215. The air outlet 214 may be located at the top of the body 210, and the airflow is discharged upward or obliquely upward from the air outlet 214. The trash outlet 215 is in communication with a trash suction port 211 through a pipe 216, and the body 210 is formed with a sealing surface 2S1. The base 220 is located below the sealing surface 2S1, and the base 220 is configured for supporting the trash cassette 21C having an opening at a top.

The suction mechanism 230 and the filter 240 are assembled to the body 210. In the embodiment of the present application, the suction mechanism 230 and the filter 240 are located at the top of the body 210, and the suction mechanism 230 is in communication with the air outlet 214. In other embodiments, the suction mechanism 230 and the filter 240 may also be located at a middle position of the body 210. As long as the suction function and the filtering function can be implemented, the positions of the suction mechanism 230 and the filter 240 can be set according to the needs of the actual application, which is not limit herein.

Figure 3:
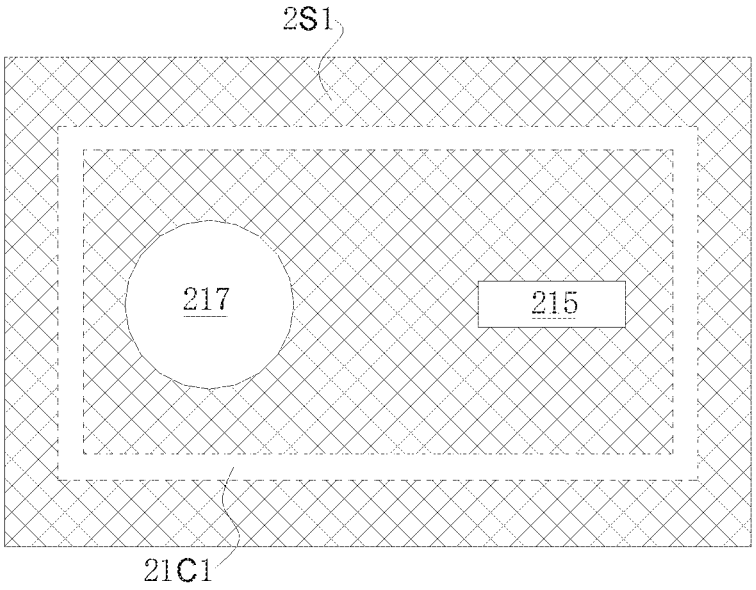
FIG. 3 is a schematic view of a sealing surface, while the sealing surface is a plane.

The spring 250 is connected to the base 220 and the body 210, and the trash cassette 21C is placed on the base 220 by an external force to urge the base 220 dropping. When the external force is released, the spring 250 provides an elastic force to urge the base 220 in a vertical direction adjacent to the sealing surface 2S1, such that the trash cassette 21C is clamped between the base 220 and the sealing surface 2S1 such that the opening edge 21C1 of the trash cassette 21C abuts against the sealing surface 2S1. As shown in FIG. 3, the body 210 is further provided with an air outlet 217, and the filter 240 can be assembled at the air outlet 217. When the opening edge 21C1 of the trash cassette 21C abuts against the sealing surface 2S1, the air outlet 217 and the trash outlet 215 are each enclosed within the range defined by the opening edge 21C1.

In actual application, the air pressure formed during the operation of the suction mechanism 230 transports the trash received in the cleaning robot 100 through the opening of the trash suction port 211, the trash outlet 215, and the trash cassette 21C, and precipitates into the trash cassette 21C through the filtering action of the filter 240. It is easy to understand that the trash suction port 211 is in communication with the trash outlet 215 through the pipe 216, such that the trash entering the pipe 216 from the trash suction port 211, is transported along the pipe 216, and then enters the trash cassette 21C from the trash outlet 215.

In the present embodiment, the trash cassette 21C may be provided with only one opening. For example, the beverage cup commonly used in the life may be used as the trash cassette 21C or the user himself may make the trash cassette 21C, even if the trash cassette 21C of industrially manufactured is used, which will have the advantage of lower cost. The sealing surface 2S1 can be designed to have a large area, and based on this, the opening of the trash cassette 21C can be not limited to a certain fixed size or shape, that is, the user can select the trash cassette 21C of industrial manufacturing or self-made having an opening with different sizes and/or shapes according to needs. In addition, since the distance between the sealing surface 2S1 and the base 220 is not stable, but can be adjusted by the rising of the base 220, the height of the trash cassette 21C is not limited to a certain stable height, that is, the user can select the trash cassette 21C of industrial manufacturing or self-made having different height according to needs. In summary, the processing station 200 can be applied to the trash cassettes 21C having different opening sizes, different opening shapes, industrial manufacturing or self-made, and different heights; the versatility is high and the production cost is low.

Figure 4:
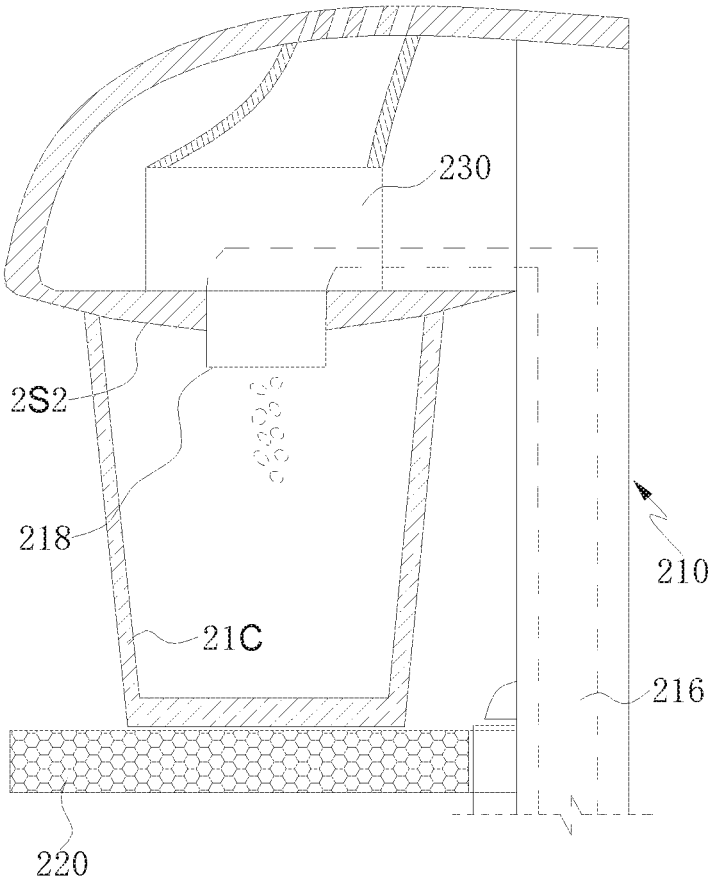
FIG. 4 is a side cross-sectional view of a processing station provided with a sealing surface having an arc surface.
Figure 5:
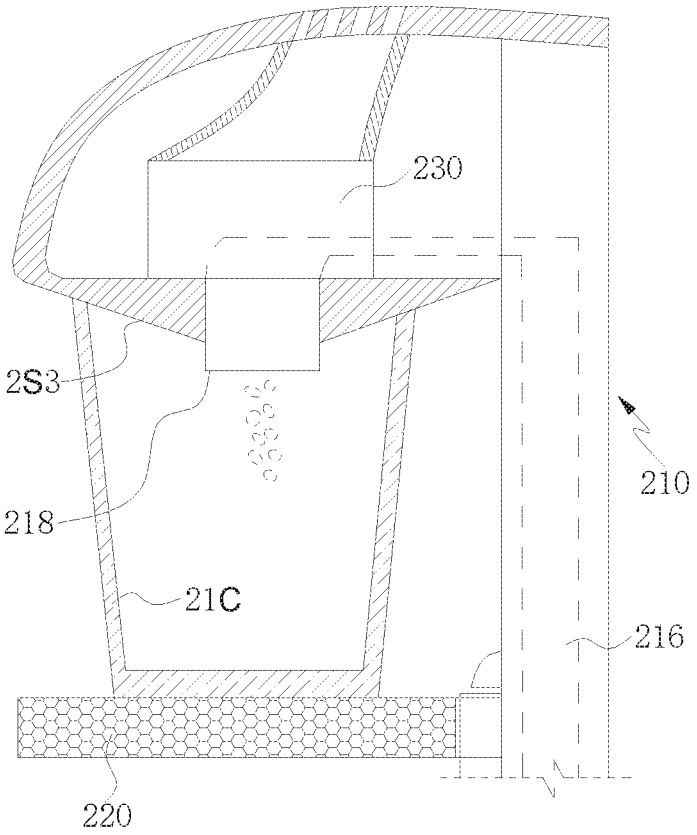
FIG. 5 is a side cross-sectional view of a processing station provided with a sealing surface having a truncated cone surface.
Figure 6:
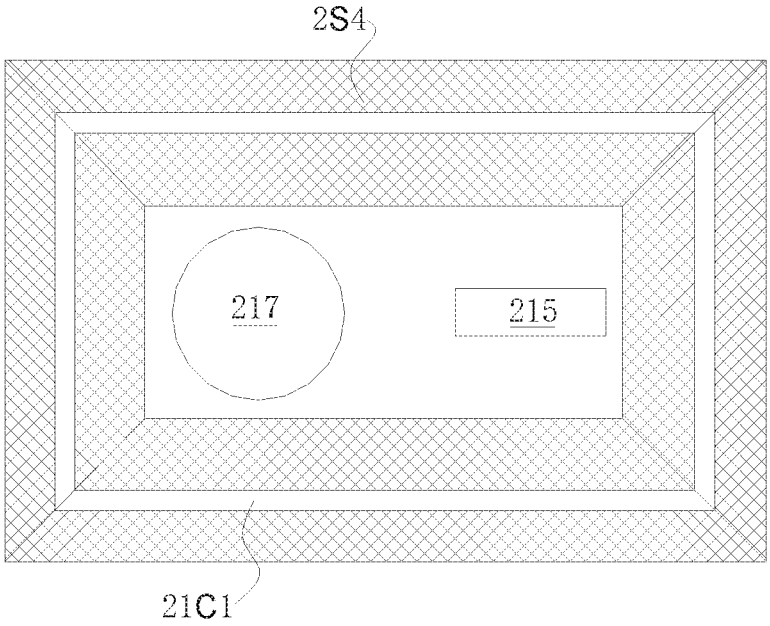
FIG. 6 is a schematic view of a sealing surface being a quadrangular frustum surface.

The sealing surface 2S1 (shaded portion in FIG. 3) may be a plane as shown in FIGS. 1 and 3; the sealing surface may also be an arc surface 2S2 as shown in FIG. 4, for example, the arc surface 2S2 is a circular arc surface; the arc surface 2S2 is convex toward the base 220, and the sealing surface may also be a truncated cone surface 2S3 as shown in FIG. 5, and the truncated cone surface 2S3 is gradually narrowed toward the base 220. Based on this, the opening edge 21C1 of the trash cassette 21C needs to be designed in a circular ring structure in order to ensure the sealing property when it abuts against the circular arc surface. The sealing surface may also be a quadrangular frustum surface 2S4 (shaded portion in FIG. 6) as shown in FIG. 6. Based on this, the opening edge 21C1 of the trash cassette 21C needs to be designed as a rectangular ring structure in order to ensure the sealing property when it abuts against the quadrangular frustum 2S4.

In an optional embodiment, the planar sealing surface 2S1, the arc surface 2S2, the truncated cone surface 2S3, and the quadrangular frustum surface 2S4 may be covered with a sealing soft glue layer, and the opening edge 21C1 of the trash cassette 21C abuts against the sealing soft glue layer for further increasing the sealing property.

As shown in FIGS. 1, 4 and 5, a conduit 218 extends from the sealing surface, and an end of the conduit 218 is in communication with the trash outlet 215. When the trash cassette 21C is clamped between the base 220 and the sealing surface 2S1, the other end of the conduit 218 extends into the trash cassette 21C.

Figure 7:
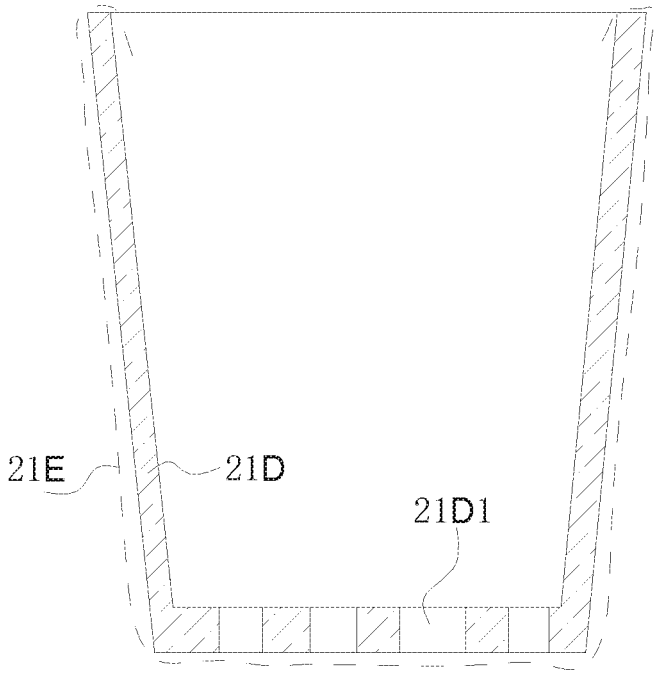
FIG. 7 is a schematic view of a trash cassette be sleeved with a trash bag according to another embodiment.

FIG. 7 is a trash cassette 21D of another embodiment, a bottom of the trash cassette 21D having a leak hole 21D1. In practical application, the trash bag 21E (indicated by a broken line) is sleeved outside the trash cassette 21D, and the edge of the trash bag 21E is placed inward on the opening edge of the trash cassette 21D, the trash cassette 21D, which is sleeved with the trash bag 21E is clamped between the base 220 and the sealing surface after the being placed on the base 220. When the trash cassette 21D is risen, the trash drops into the trash bag 21E through the leak hole 21D1, and then the trash bag 21E containing the trash can be thrown away.

In the embodiment of the present application, the external force that urges the base 220 to drop is provided by manually pressing the base 220, the trash cassette 21C, 21D is placed on the base 220 after the base 220 is dropped, and the external force is released after the hand is released, and the spring 250 provides an elastic force driving the base 220 to be adjacent to the sealing surface in the vertical direction to clamp the trash cassette 21C, 21D between the base 220 and the sealing surface such that the opening edges of the trash cassette 21C, 21D abut against the sealing surface.

In other embodiments, the processing station 200 also includes a power mechanism (not shown) mounted to the body 210, and the power mechanism is configured to provide an external force for driving the base 220 to drop or to rise. The power mechanism may be any one of a motor, a cylinder, a steering gear, etc., and the connection between the power mechanism and the base 220 may be through a gear pair, a belt, a screw, or the like. The base 220 or the sealing surface is provided with a pressure sensor communicably connected to the power mechanism, and the power mechanism adjusts the height of the base 220 rising according to the detection information of the pressure sensor, which avoids excessive pressure applied to the trash cassette 21C, 21D and damages the trash cassette 21C, 21D.

Figure 8:
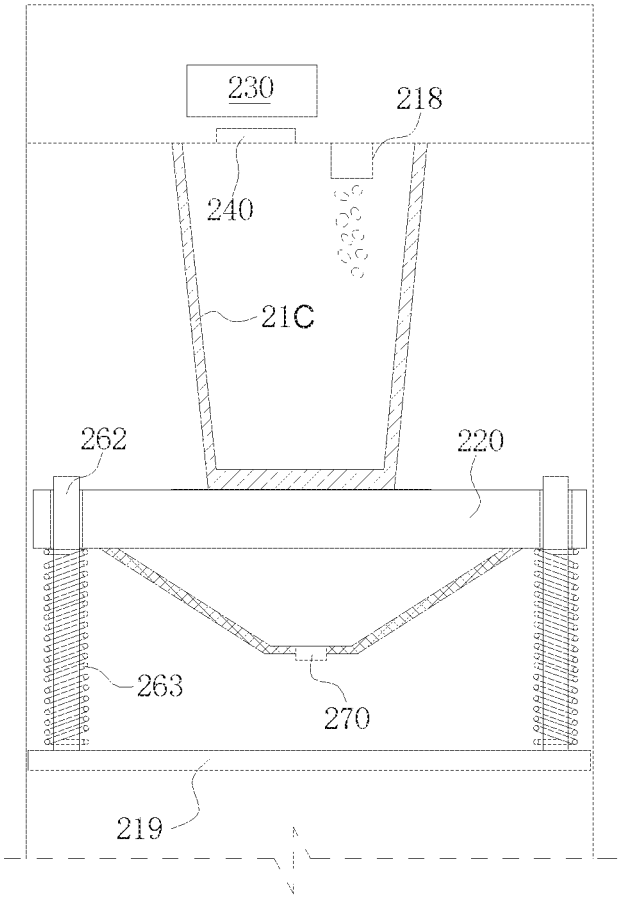
FIG. 8 is a front cross-sectional view of a processing station, wherein a base is provided with an alignment detection device.

In the embodiment, the body 210 is provided with a plurality of guide rails 261. The base 220 slides in the vertical direction along the guide rails, the body 210 is extended with a support portion 219, and the support portion 219 is located below the base 220, as shown in FIGS. 1 and 2, and the spring 250 connects the support portion 219 and the base 220. The body 210 is provided with a guide rail 261, the base 220 is provided with a guide hole or a notch, and the guide rail 261 is assembled with the guide hole or the notch. As shown in FIG. 8, the support portion 219 is provided with a plurality of guide rails 262, for example two, three or four; each of the guide rails 262 is sleeved with a spring 263, when the base 220 drops along the guide rail 262 in a vertical direction, the spring 263 is compressed to provide an elastic force that clamps the trash cassette 21C, 21D between the base 220 and the sealing surface.

In practical applications, when the trash cassette 21C is placed on the base 220, it is inevitably deviated from the preset position on the base 220, which may result in failure to seal when the opening edge 21C1 of the trash cassette 21C abuts against the sealing surface, or either or both of the air outlet 217 and the trash outlet 215 are not enclosed within the range defined by the opening edge 21C1. In order to intelligently detect whether the trash cassette 21C is deviated from the preset position when the trash cassette 21C is placed on the base 220, as shown in FIG. 8, in an optional embodiment, the base 220 is provided with the alignment detection device 270 and the information prompting device (not shown), the alignment detection device 270 is configured to generate a feedback information when it is detected that the trash cassette 21C deviates from a preset position on the base 220; the information prompting device is configured to generate correction prompting information based on the feedback information.

In the present embodiment, the alignment detection device 270 includes an image detection device disposed below the base 220 and disposed toward the base 220, the image detection device includes a camera assembly, and the base 220 is a transparent glass plate. When the trash cassette 21C is placed on the base 220, the image detection device can capture a picture including the bottom of the trash cassette 21C through the transparent glass plate, and determining whether the trash cassette 21C deviates from the base 220 by analyzing the position of the bottom of the trash cassette 21C in the picture, the feedback information will be generated if it deviates from the preset position on the base 220. In other embodiments, the alignment detection device 270 includes: a non-contact sensing element disposed in the trash cassette 21C and a non-contact sensing sensor disposed on the base 220 or the body 210, wherein the non-contact sensing element can be sensed by the non-contact sensing sensor when the trash cassette 21C is placed at a preset position on the base 220, and if the non-contact sensing sensor does not sense the non-contact sensing element, a feedback information is generated.

In this embodiment, the information prompting device may include a voice prompting device, and the voice prompting device generates voice type correction prompting information according to the feedback information. The information prompting device may further include a visual prompting device, for example, an LED display device, an LCD display device, or the like, and the visual prompting device generates visualized correction prompting information such as an image, a symbol, and a light flicker according to the feedback information.

Embodiment 2

Figure 9:
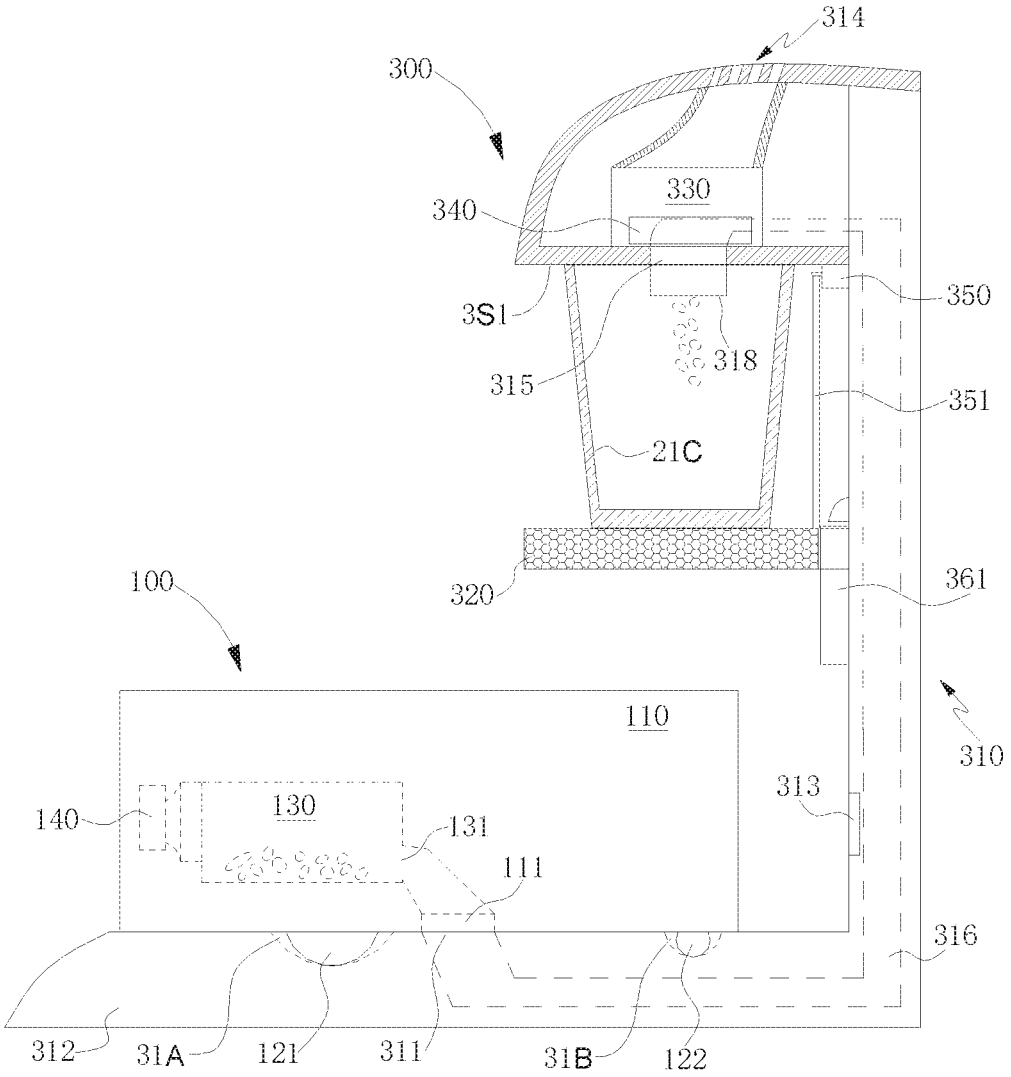
FIG. 9 is a side cross-sectional view of a processing station according to a second embodiment.

A processing station 300 is shown in FIG. 9, the processing station 300 is configured for evacuating trash collected in a cleaning robot 100, and the processing station 300 includes a body 310, a base 320, a suction mechanism 330, a filter 340 and an adjustment member. In the embodiment of the present application, the adjustment member includes the power mechanism 350 as an example for description.

A bottom of the body 310 is provided with a trash suction port 311. In the embodiment of the present application, the bottom of the body 310 is formed with a bottom base 312, and the trash suction port 311 is provided on the bottom base 312. When the cleaning robot 100 travels to a preset position on the bottom base 312, for example, the trash suction port 311 is docked with the dust suction port 111; for example, the cleaning robot 100 may additionally provide a trash evacuation port in communication with the trash receiving case 130, and the trash suction port 311 is docked with the trash evacuation port. In the embodiment of the present application, the trash suction port 311 is docked with the dust suction port 111 as an example for description.

In order to realize a function of the processing station 300 charging the cleaning robot 100, the body 310 can be provided with a metal contact, and when a charging contact on the cleaning robot 100 comes into contact with the metal contact on the body 310, the docking charging of the cleaning robot 100 is realized. In addition, in order to guide the cleaning robot 100 to accurately dock with the processing station 300, such that the trash suction port 311 is aligned with the dust suction port 111 of the cleaning robot 100, and the body 310 may be provided with an optical signal guiding system 313, the cleaning robot 100 receives an optical signal (such as an infrared ray) sent by the optical signal guiding system 313 to find the processing station 300 and to achieve precise docking with the processing station 300.

The bottom base 312 is provided with a first groove 31A for accommodating the driving wheel 121 and a second groove 31B for accommodating the universal wheel 122. In the embodiment of the present application, the preset position represents the position when the driving wheel 121 enters the first groove 31A and the universal wheel 122 enters the second groove 31B.

The body 310 is provided with an air outlet 314 and a trash outlet 315. The air outlet 314 may be located at the top of the body 310, and the airflow is discharged upward or obliquely upward from the air outlet 314. The trash outlet 315 is in communication with a trash suction port 311 through a pipe 316, and the body 310 is formed with a sealing surface 3S1. The base 320 is located below the sealing surface 3S1, and the base 320 is configured for supporting the trash cassette 21C having an opening at a top.

The suction mechanism 330 and the filter 340 are assembled to the body 210. In the embodiment of the present application, the suction mechanism 330 and the filter 340 are located at the top of the body 310, and the suction mechanism 330 is in communication with the air outlet 314. In other embodiments, the suction mechanism 330 and the filter 340 may also be located at a middle position of the body 310. As long as the suction function and the filtering function can be implemented, the positions of the suction mechanism 330 and the filter 340 can be set according to the needs of the actual application, which is not limit herein.

The power mechanism 350 is mounted on the body 310 and configured to urge the base 320 to approach and away from the sealing surface 3S1 in the vertical direction to clamp the trash cassette 21C between the base 320 and the sealing surface 3S1, such that the opening edge 21C1 of the trash cassette 21C abuts against the sealing surface 3S1. The power mechanism 350 may be any one of a motor, a cylinder, a steering gear, etc., and the power mechanism 350 may be connected to the base 320 by a gear pair, a belt, a screw, or the like. In the present embodiment, the power mechanism 350 is connected to the base 320 via a belt 351. The base 320 or the sealing surface 3S1 is provided with a pressure sensor communicably connected to the power mechanism 350. The power mechanism 350 adjusts the height of the rising and dropping of the base 320 according to the detection information of the pressure sensor, so as to avoid excessive pressure applied to the trash cassette 21C and damage the trash cassette 21C.

In actual application, the air pressure formed during the operation of the suction mechanism 330 transports the trash received in the cleaning robot 100 through the opening of the trash suction port 311, the trash outlet 315, and the trash cassette 21C, and precipitates into the trash cassette 21C through the filtering action of the filter 340. It is easy to understand that the trash suction port 311 is in communication with the trash outlet 315 through the pipe 316, such that the trash entering the pipe 316 from the trash suction port 311, is transported along the pipe 316, and then enters the trash cassette 21C from the trash outlet 315.

In the present embodiment, the trash cassette 21C may be provided with only one opening. For example, the beverage cup commonly used in the life may be used as the trash cassette 21C or the user himself may make the trash cassette 21C, even if the trash cassette 21C of industrially manufactured is used, which will have the advantage of lower cost. The sealing surface 3S1 can be designed to have a large area, and based on this, the opening of the trash cassette 21C can be not limited to a certain fixed size or shape, that is, the user can select the trash cassette 21C of industrial manufacturing or self-made having an opening with different sizes and/or shapes according to needs. In addition, since the distance between the sealing surface 3S1 and the base 220 is not stable, but can be adjusted by the rising of the base 320, the height of the trash cassette 21C is not limited to a certain stable height, that is, the user can select the trash cassette 21C of industrial manufacturing or self-made having different height according to needs. In summary, the processing station 300 can be applied to the trash cassettes 21C having different opening sizes, different opening shapes, industrial manufacturing or self-made, and different heights; the versatility is high and the production cost is low.

The sealing surface 3S1 may be a plane as shown in FIG. 9; the sealing surface may also be an arc surface 2S2 as shown in FIG. 4, for example, the arc surface 2S2 is a circular arc surface; the sealing surface may also be a truncated cone surface 2S3 as shown in FIG. 5, the sealing surface may also be a quadrangular frustum surface 2S4 (shaded portion in FIG. 6) as shown in FIG. 6. Based on this, the opening edge 21C1 of the trash cassette 21C needs to be designed as a rectangular ring structure in order to ensure the sealing property when it abuts against the quadrangular frustum 2S4.

In an optional embodiment, the planar sealing surface 3S1, the arc surface 2S2, the truncated cone surface 2S3, and the quadrangular frustum surface 2S4 may be covered with a sealing soft glue layer, and the opening edge 21C1 of the trash cassette 21C abuts against the sealing soft glue layer for further increasing the sealing property.

As shown in FIG. 9, a conduit 318 extends from the sealing surface 3S1, and an end of the conduit 318 is in communication with the trash outlet 315. When the trash cassette 21C is clamped between the base 320 and the sealing surface 3S1, the other end of the conduit 318 extends into the trash cassette 21C. The trash cassette 21C can also be replaced into the trash cassette 21D shown in FIG. 7.

In the present embodiment, the base 310 is provided with a plurality of guide rails 361, and the base 320 slides along the guide rails in a vertical direction. The body is provided with a guide rail 361, and the base 320 is provided with a guide hole or a notch, and the guide rail 361 is assembled with the guide hole or the notch.

In the present embodiment, the processing station 300 shown in FIG. 9 can employ the alignment detection device 270 shown in FIG. 8, and cooperates with an information prompting device, and alignment detection device 270 is configured to generate a feedback information when it is detected that the trash cassette 21C deviates from a preset position on the base 220; the information prompting device is configured to generate correction prompting information based on the feedback information.

Embodiment 3

Figure 10:
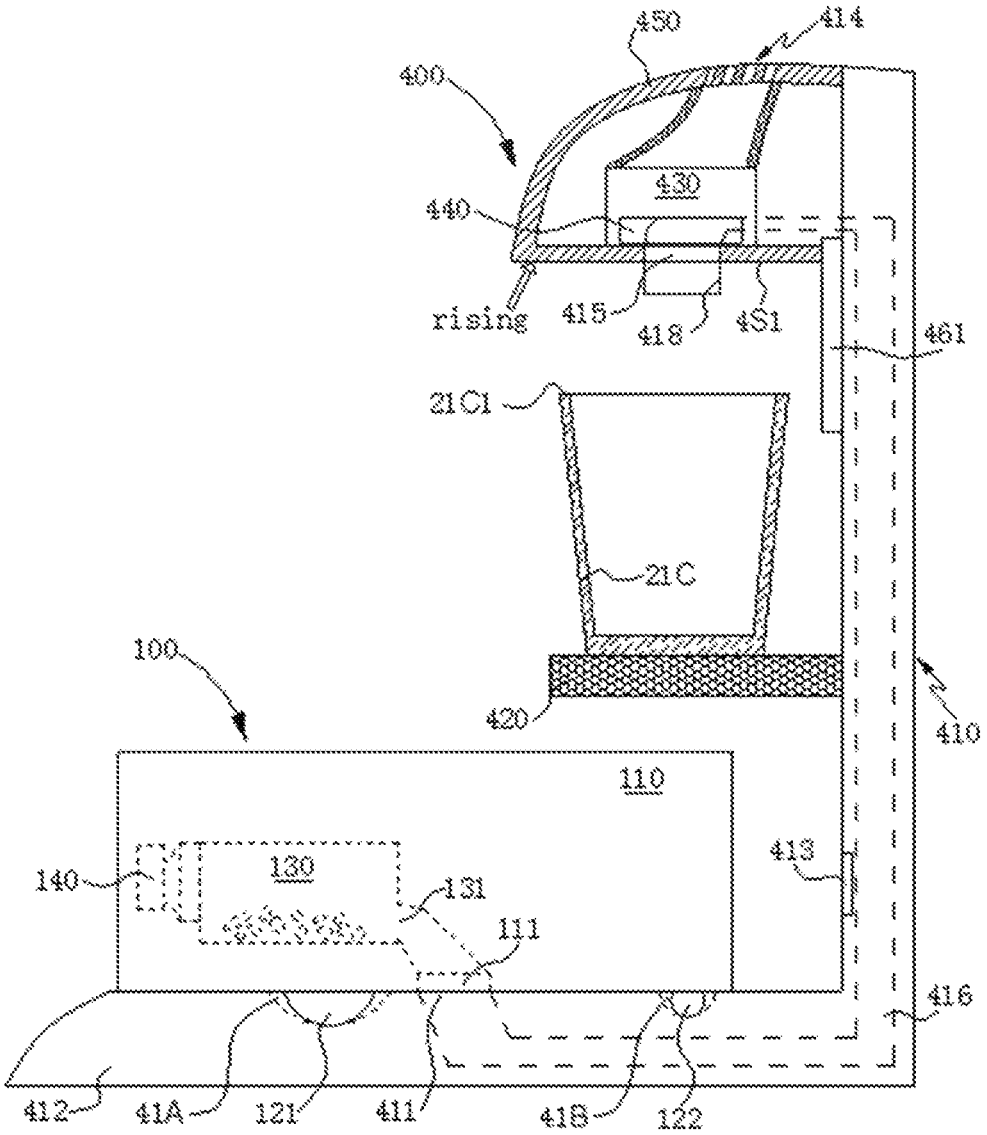
FIG. 10 is a side cross-sectional view of a processing station according to a third embodiment.

A processing station 400 is shown in FIG. 10, the processing station 400 is configured for evacuating trash collected in a cleaning robot 100, and the processing station 400 includes a body 410, a base 420, a suction mechanism 430, a filter 440, and an receiving case 450.

A bottom of the body 410 is provided with a trash suction port 411. In the embodiment of the present application, the bottom of the body 410 is formed with a bottom base 412, and the trash suction port 411 is provided on the bottom base 412. When the cleaning robot 100 travels to a preset position on the bottom base 412, for example, the trash suction port 411 is docked with the dust suction port 111; for example, the cleaning robot 100 may additionally provide a trash evacuation port in communication with the trash receiving case 130, and the trash suction port 411 is docked with the trash evacuation port. In the embodiment of the present application, the trash suction port 411 is docked with the dust suction port 111 as an example for description.

In order to realize a function of the processing station 400 charging the cleaning robot 100, the body 410 can be provided with a metal contact, and when a charging contact on the cleaning robot 100 comes into contact with the metal contact on the body 410, the docking charging of the cleaning robot 100 is realized. In addition, in order to guide the cleaning robot 100 to accurately dock with the processing station 400, such that the trash suction port 411 is aligned with the dust suction port 111 of the cleaning robot 100, and the body 410 may be provided with an optical signal guiding system 413, the cleaning robot 100 receives an optical signal (such as an infrared ray) sent by the optical signal guiding system 413 to find the processing station 400 and to achieve precise docking with the processing station 400.

The bottom base 412 is provided with a first groove 41A for accommodating the driving wheel 121 and a second groove 41B for accommodating the universal wheel 122. In the embodiment of the present application, the preset position represents the position when the driving wheel 121 enters the first groove 41A and the universal wheel 122 enters the second groove 41B.

The receiving case 450 is slidably connected to the top of the body 410 in the vertical direction. A bottom of the receiving case 450 is provided with an air outlet 414 and a trash outlet 415. The air outlet 414 may be located at the top of the body 410, and the airflow is discharged upward or obliquely upward from the air outlet 414. The trash outlet 415 is in communication with a trash suction port 411 through a pipe 416, and the receiving case 450 is formed with a sealing surface 4S1. The base 420 is located below the receiving case 450, and the base 420 is configured to place the trash cassette 21C having an opening at a top.

The suction mechanism 430 and the filter 440 are assembled in the receiving case 450, and the suction mechanism 430 is in communication with the air outlet 414.

The trash cassette 21C is placed on the base 420 by an external force driving the receiving case 450 to be risen, and when the external force is released, the receiving case 450 is adjacent to the base 420 to clamp the trash cassette 21C between the base 420 and the receiving case 450, such that the opening edge of the trash cassette 21C abuts against the sealing surface 4S1. The air pressure formed during the operation of the suction mechanism 430 transports the trash received in the cleaning robot 100 through the opening of the trash suction port 411, the trash outlet 415, and the trash cassette 21C, and precipitates into the trash cassette 21C through the filtering action of the filter 440.

In the embodiment of the present application, the external force that urges the receiving case 450 to be risen is provided by manually rising the receiving case 450. When the external force is released, the receiving case 450 can be dropped to approach the base 420 under the gravity of the receiving case 450 itself. In other embodiments, an external force that urges the receiving case 450 to rise and/or to drop may also using a power mechanism. The power mechanism may be any one of a motor, a cylinder, a steering gear, etc., and the connection between the power mechanism and the receiving case 450 may be through a gear pair, a belt, a screw, or the like. The sealing surface 4S1 is provided with a pressure sensor communicably connected to the power mechanism, and the power mechanism adjusts the height of the rising and dropping of the receiving case 450 according to the detection information of the pressure sensor, so as to avoid excessive pressure applied to the trash cassette 21C and damage the trash cassette 21C.

In the present embodiment, the trash cassette 21C may be provided with only one opening. For example, the beverage cup commonly used in the life may be used as the trash cassette 21C or the user himself may make the trash cassette 21C, even if the trash cassette 21C of industrially manufactured is used, which will have the advantage of lower cost. The sealing surface 4S1 can be designed to have a large area, and based on this, the opening of the trash cassette 21C can be not limited to a certain fixed size or shape, that is, the user can select the trash cassette 21C of industrial manufacturing or self-made having an opening with different sizes and/or shapes according to needs. In addition, since the distance between the sealing surface 4S1 and the base 420 is not stable, but can be adjusted by the rising of the receiving case 450, the height of the trash cassette 21C is not limited to a certain stable height, that is, the user can select the trash cassette 21C of industrial manufacturing or self-made having different height according to needs. In summary, the processing station 400 can be applied to the trash cassettes 21C having different opening sizes, different opening shapes, industrial manufacturing or self-made, and different heights; the versatility is high and the production cost is low.

The sealing surface 4S1 may be a plane as shown in FIG. 10; the sealing surface may also be an arc surface 2S2 as shown in FIG. 4, for example, the arc surface 2S2 is a circular arc surface; the sealing surface may also be a truncated cone surface 2S3 as shown in FIG. 5, the sealing surface may also be a quadrangular frustum surface 2S4 (shaded portion in FIG. 6) as shown in FIG. 6. Based on this, the opening edge 21C1 of the trash cassette 21C needs to be designed as a rectangular ring structure in order to ensure the sealing property when it abuts against the quadrangular frustum 2S4.

In an optional embodiment, the planar sealing surface 4S1, the arc surface 2S2, the truncated cone surface 2S3, and the quadrangular frustum surface 2S4 may be covered with a sealing soft glue layer, and the opening edge 21C1 of the trash cassette 21C abuts against the sealing soft glue layer for further increasing the sealing property.

As shown in FIG. 10, a conduit 418 extends from the sealing surface 4S1, and an end of the conduit 418 is in communication with the trash outlet 415. When the trash cassette 21C is clamped between the base 420 and the sealing surface 4S1, the other end of the conduit 418 extends into the trash cassette 21C. The trash cassette 21C can also be replaced into the trash cassette 21D shown in FIG. 7.

In the present embodiment, the base 410 is provided with a plurality of guide rails 461, and the base 420 slides along the guide rails in a vertical direction. The body 410 is provided with a guide rail 461, and the base 420 is provided with a guide hole or a notch, and the guide rail 461 is assembled with the guide hole or the notch.

In the present embodiment, the processing station 400 shown in FIG. 10 can employ the alignment detection device 270 shown in FIG. 8, and cooperates with an information prompting device, and alignment detection device 270 is configured to generate a feedback information when it is detected that the trash cassette 21C deviates from a preset position on the base 220; the information prompting device is configured to generate correction prompting information based on the feedback information.

In the description of the present specification, the description to the reference terms "an embodiment", "some embodiments", "example", "specific example" or "an optional embodiment", etc. refer to particular features, structures, materials or characteristics are included in at least one embodiment or example of the present application. In the present specification, the schematic representation of the above terms does not necessarily mean the same embodiment or example. Furthermore, the particular features, structures, materials, or characteristics described may be combined in a suitable manner in any one or more embodiments or examples.

The aforementioned embodiments are only preferred embodiments of the present application, and should not be regarded as being limitation to the present application. Any modification, equivalent replacement, improvement, and so on, which are made within the spirit and the principle of the present application, should be included in the protection scope of the present application.

What is claimed is:

1. A processing station for evacuating trash collected in a cleaning robot, comprising:

a body, wherein a bottom of the body is provided with a trash suction port, and the body is provided with an air outlet and a trash outlet, the trash outlet is in communication with the trash suction port, and the body is formed with a sealing surface;

a base, located below the sealing surface and configured for supporting a trash cassette having an opening at a top;

a suction mechanism and a filter, assembled to the body, wherein the suction mechanism is in communication with the opening and the air outlet; and an adjustment member, connected with the body and the base and configured to urge the base to be vertically adjacent to the sealing surface to clamp the trash cassette between the base and the sealing surface, such that the opening edge of the trash cassette abuts against the sealing surface;

wherein an air pressure formed during the operation of the suction mechanism sequentially transports the trash collected in the cleaning robot through the trash suction port, the trash outlet, and the opening and precipitates into the trash cassette through a filtering action of the filter.

2. The processing station of claim 1, wherein the adjustment member comprises a spring; wherein the trash cassette is placed on the base by an external force to lower the base, and when the external force is released, the spring provides an elastic force to urge the base to be adjacent to the sealing surface in the vertical direction.

3. The processing station of claim 2, wherein the adjustment member further comprises a power mechanism mounted to the body, and the power mechanism configured to provide the external force for driving the base to drop.

4. The processing station of claim 3, wherein the sealing surface is provided with a pressure sensor communicatively connected to the power mechanism, and the power mechanism adjusts the based on detection information of the pressure sensor.

5. The processing station of claim 1, wherein the adjustment member further comprises a power mechanism mounted to the body, and the power mechanism configured to urge the base in a vertical direction adjacent to and away from the sealing surface.

6. The processing station of claim 1, wherein the sealing surface comprises an arc surface raised toward the base; when the trash cassette is clamped between the base and the sealing surface, the opening edge of the trash cassette abuts against the arc surface.

7. The processing station of claim 6, wherein the arc surface is covered with a sealing soft glue layer.

8. A processing station for evacuating trash collected in a cleaning robot, comprising:

a body, wherein a bottom of the body is provided with a trash suction port;

a receiving case, slidably connected to a top of the body in a vertical direction;

wherein a bottom of the receiving case is formed with a sealing surface and is provided with an air outlet and a trash outlet, and the trash outlet is connected with the trash suction port;

a suction mechanism and a filter, disposed in the receiving case; and a base, located below the receiving case and configured for supporting a trash cassette having an opening at a top;

wherein the trash cassette is placed on the base after the receiving case is raised by an external force, and when the external force is released, the receiving case is adjacent to the base to clamp the trash cassette between the base and the receiving case, such that the opening edge of the trash cassette abuts against the sealing surface; wherein an air pressure formed during the operation of the suction mechanism sequentially transports the trash collected in the cleaning robot through the trash suction port, the trash outlet, and the opening and precipitates into the trash cassette through a filtering action of the filter.

9. The processing station of claim 8, wherein the base is provided with an alignment detection device and an information prompting device; wherein the alignment detection device is configured to generate a feedback information when the trash cassette is detected offset from a preset position on the base; the information prompting device is configured to generate the correction prompt information according to the prompting of the feedback information.

10. The processing station of claim 9, wherein the base is a transparent glass plate, and the alignment detection device comprises a image detection device located below the base and disposed toward the base.

11. A cleaning system, comprising a cleaning robot and the processing station;

wherein the processing station comprises:

a body, wherein a bottom of the body is provided with a trash suction port, and the body is provided with an air outlet and a trash outlet, the trash outlet is in communication with the trash suction port, and the body is formed with a sealing surface;

a base, located below the sealing surface and configured for supporting a trash cassette having an opening at a top;

a suction mechanism and a filter, assembled to the body, wherein the suction mechanism is in communication with the opening and the air outlet; and an adjustment member, connected with the body and the base and configured to urge the base to be vertically adjacent to the sealing surface to clamp the trash cassette between the base and the sealing surface, such that the opening edge of the trash cassette abuts against the sealing surface;

wherein an air pressure formed during the operation of the suction mechanism sequentially transports the trash collected in the cleaning robot through the trash suction port, the trash outlet, and the opening and precipitates into the trash cassette through a filtering action of the filter.

12. The cleaning system of claim 11, wherein the cleaning robot comprises:

a robot body, wherein a bottom of the robot body is provided with a dust suction port;

a drive system, configured to drive the cleaning robot to travel on the ground;

a trash receiving case, wherein an inlet of the trash receiving case is in communication with the dust suction port; and a fan, which the trash on the ground to sequentially enter the trash receiving case from the dust suction port and the inlet when the fan is activated.

13. The cleaning system of claim 11, wherein the adjustment member comprises a spring; wherein the trash cassette is placed on the base by an external force to lower the base, and when the external force is released, the spring provides an elastic force to urge the base to be adjacent to the sealing surface in the vertical direction.

14. The cleaning system of claim 13, wherein the adjustment member further comprises a power mechanism mounted to the body, and the power mechanism configured to provide the external force for driving the base to drop.

15. The cleaning system of claim 14, wherein the sealing surface is provided with a pressure sensor communicatively connected to the power mechanism, and the power mechanism adjusts the based on detection information of the pressure sensor.

16. The cleaning system of claim 11, wherein the adjustment member further comprises a power mechanism mounted to the body, and the power mechanism configured to urge the base in a vertical direction adjacent to and away from the sealing surface.

17. The cleaning system of claim 11, wherein the sealing surface comprises an arc surface raised toward the base; when the trash cassette is clamped between the base and the sealing surface, the opening edge of the trash cassette abuts against the arc surface.

* * * * *